United States Patent [19]

Schnier

[11] 4,340,247

[45] Jul. 20, 1982

[54] GRIPPER UNIT FOR CLAMPING AND ALIGNING A LAYER OF CONCRETE PAVING BRICKS WITH COMPOUND ELEMENTS FOR FORMING A STRETCHER BOND OF THE BRICKS INTO A SETTING UNIT

[75] Inventor: Egon Schnier, Höfen, Fed. Rep. of Germany

[73] Assignee: Oldenburger Betonsteinwerke GmbH, Wardenburg, Fed. Rep. of Germany

[21] Appl. No.: 99,354

[22] Filed: Dec. 3, 1979

[30] Foreign Application Priority Data

May 5, 1979 [DE] Fed. Rep. of Germany ..... 2918232

[51] Int. Cl.[3] ..... B66C 1/44

[52] U.S. Cl. ..... 294/63 R; 294/67 BB; 294/87 R

[58] Field of Search ..... 294/62, 63 R, 65, 67 R, 294/67 B, 67 BB, 67 BC, 81 R, 86 R, 87 R, 87 A, 88; 414/59, 71, 416

[56] References Cited

U.S. PATENT DOCUMENTS

| | | | |
|---|---|---|---|
| 3,270,897 | 9/1966 | Lingl | 294/63 R X |
| 3,302,967 | 2/1967 | Harris et al. | 294/65 |
| 3,506,140 | 4/1970 | Koch et al. | 294/87 A X |
| 3,929,234 | 12/1975 | Warren | 414/416 X |

*Primary Examiner*—Johnny D. Cherry

*Attorney, Agent, or Firm*—Allison C. Collard; Thomas M. Galgano

[57] ABSTRACT

A gripper unit for clamping and aligning a layer of concrete paving bricks with compound elements for forming a stretcher bond of the bricks into the form of a setting unit by means of clamping bars which can each engage at their longitudinal edges a row of bricks. The clamping bars are simultaneously longitudinally and laterally displaceable on a frame-like support element, and are mounted on the associated support element by means of a guide cross bushing. Adjacent clamping bars have at least one common hinged lever which acts as a parallelogram control and which is coupled with an actuating device for effecting pivotable movement thereof.

3 Claims, 1 Drawing Figure

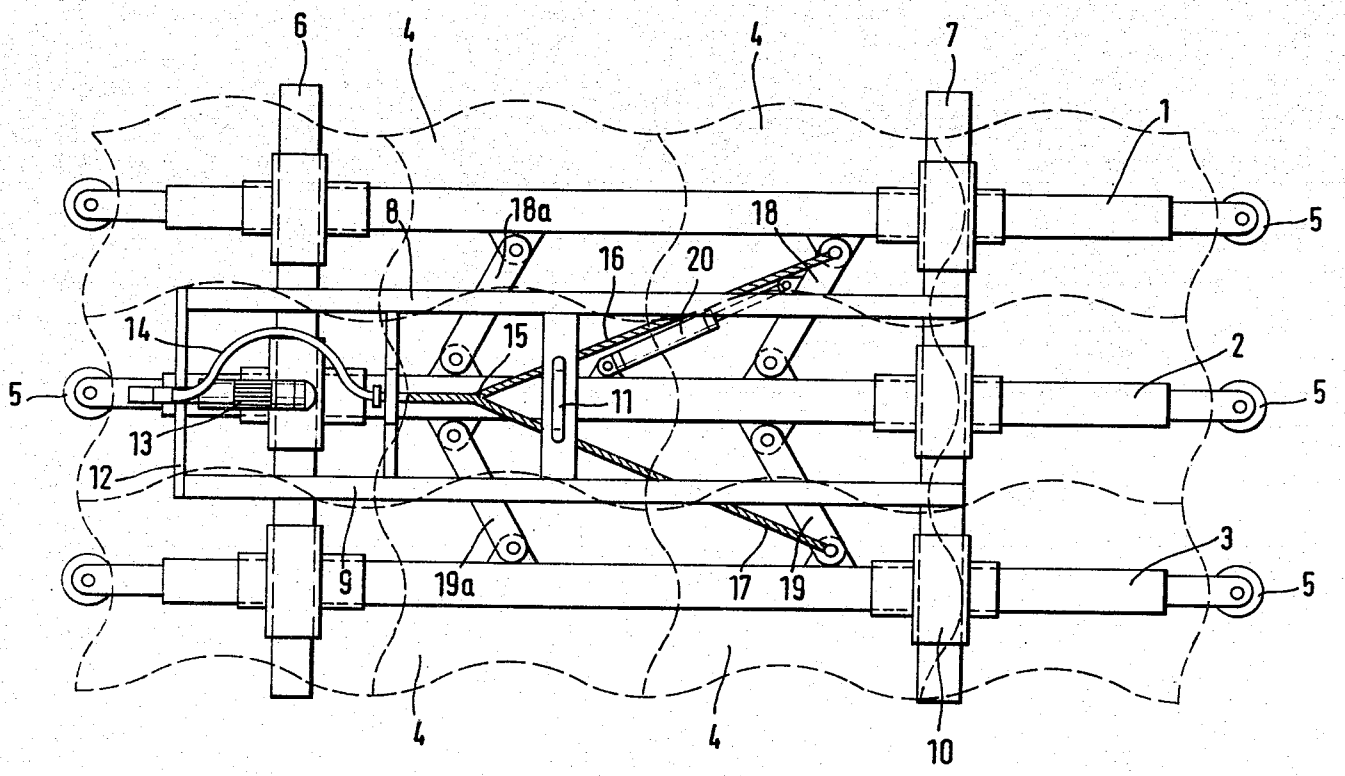
1
2
3
4
5
6
7
8
9
10
11
12
13
14
15
16
17
18
18a
19
19a
20

GRIPPER UNIT FOR CLAMPING AND ALIGNING A LAYER OF CONCRETE PAVING BRICKS WITH COMPOUND ELEMENTS FOR FORMING A STRETCHER BOND OF THE BRICKS INTO A SETTING UNIT

The invention relates to a gripper unit for clamping and aligning a layer of concrete paving bricks with compound elements for forming a stretcher bond of the bricks into a setting unit. More particularly, it relates to such a unit which is provided with clamping bars which can each engage between their edges a row of bricks, and which are simultaneously longitudinally and laterally displaceable on a frame-like support element on which they are mounted by means of a guide cross bushing.

Such a gripper unit is disclosed in the German design Pat. No. 77 36 974. With this known device, a row of bricks which are arranged in one layer are clamped together with clamping elements. The adjacent clamped together rows are separated and the separated rows are alternately displaced longitudinally relative to each other and are then again pushed together into a closed, compact arrangement. Thereby, the individual rows of bricks are first clamped togther and moved away from each other in such a way that they can be pushed into a position without being hindered by their protruding compound elements, so that in the subsequent clamping of the paving bricks a setting unit is obtained wherein the paving bricks with the compound elements are aligned, for example, in a stretcher bond.

The drive elements for generating the different movements in grippers of the aforementioned type are operating cylinders, in particular, hydraulically-operating cylinders, since these cylinders may be coupled to the present pressure cycle of a hoisting device, for example, a loading crane. First of all, a hydraulic operating cylinder for actuating the clamping elements is required, so that the individual rows of bricks can be clamped in a desired position. A further operating cylinder is required to move the clamping elements together with the clamped bricks and to move the rows of bricks away from each other and again toward each other. Finally, a third operating cylinder is required to displace the separated clamping elements together with the rows of bricks in an alternating longitudinal direction with respect to each other. This relatively large amount of operting cylinders require construction expenses which are considered to be disadvantageous.

The paving bricks which were collected into a setting unit with the grippers may also be set with these grippers. For this purpose the gripper is detached from an outrigger of the hoisting device which is mounted on a chassis and which moves the paving bricks from the storage place to the setting site. However, since the chassis has to be moved on freshly set paving bricks which cannot withstand any stress, track grooves may occur which are undesirable. Therefore, the chassis with the suspended grippers should be constructed as light as possible. The plurality of the required operating cylinders of the gripper, as well as the associated expense in construction for their control, results in an undesirable increase in weight.

It is therefore an object of the invention to provide an improved gripper unit of the above-mentioned type which affords a weight reduction by eliminating the operating cylinders, while still maintaining a full and effective operating unit.

This object of the invention is obtained in accordance with the invention in that the adjacent clamping bars or elements have at least a common hinged or pivotable lever which acts as a parallelogram control and which is coupled with an actuating device for effecting its pivoting.

While in the known gripper unit the lateral and longitudinal displacement of the clamping bars is carried out in a separate operation, wherein at first the clamping bars are laterally moved apart and after completing this movement the longitudinal displacement of the clamping bars occurs, the present invention carries these movements out simultaneously by the inventive use of pivot levers acting as a parallelogram control. The pivot levers move the clamping bars on a circular path, the radius of which is predetermined by the length of the pivot levers. For example, the pivot levers may be supported at one end on a center clamping bar such that they extend from each side of the center bar and are again pivotably coupled at their free end to an adjacent clamping bar. When these pivot levers are pivoted, the side clamping bars move relative to the fixed center clamping bar in a circular path which is fixed by the length of the pivot levers. Thereby, the rows of bricks which are gripped by the clamping bars are first moved apart from each other and are then offset by one-half brick length, for example, until the pivoted levers have reached an end position, whereby the offset bricks of the row of bricks are now in a tight closed relationship with each other. For this combined movement, only one operating cylinder is required which can move a plurality of pivot levers simultaneously by means of Bowden cables, for example. The Bowden cables also have the advantage that a further reduction in weight is obtained, since numerous rods and levers are eliminated.

In order to move the pivot lever and thereby the total gripper unit back into its initial position, at least one reverse element is provided which can pivot the pivot levers as well as the operating cylinder. A simple tension spring may be provided as the reverse element, for example, which acts against the force of the operating cylinder and which serves to suppress the pivot levers from pivoting out. In a preferred embodiment of the invention a pneumatic cylinder is provided as the reverse element which acts against the pivot force of the operating cylinder.

Due to the inventive measures, a substantial reduction of weight is obtained with respect to the known gripper unit, since at least one operating cylinder with its associated elements can be eliminated. A further advantage is the simplified construction of the gripper unit by using a simple pivot lever.

Other objects and features of the present invention will become apparent from the following detailed description, considered in connection with the accompanying drawing, which discloses a single embodiment of the invention. It is to be understood, however, that the drawing is designed for the purpose of illustration only, and not as a definition of the limits of the invention.

In the drawing, a schematically-illustrated plan view of a gripping unit embodying the present invention is shown.

The gripping unit consists of three parallel clamping bars or elements 1, 2, 3, each of which can clamp one row of paving bricks 4 shown in dotted lines. The lengths of these clamping bars 1, 2, and 3 may be shortened telescopically by actuating elements (not shown), so that the clamping members 5 at the ends of each clamping bar may be adjusted to press or clamp together a respective row of bricks in a longitudinal direction. Lateral arms 6 and 7 run laterally with respect to the clamping bars 1, 2 and 3 and are fixedly coupled to each other by means of longitudinal arms 8 and 9, thus forming frame-like support elements for the clamping bars 1, 2 and 3. The clamping bars with the shown cross bushings 10 are slidably mounted on lateral arms 6 and 7 and can freely move within the cross bushings, even in their longitudinal direction.

A suspension eyelet 11 is provided on the longitudinal arms 8 and 9 for coupling to a hoisting device.

As illustrated on the left side of the drawing, the longitudinal arms 8 and 9 are coupled to the front face of a crossbar 12 on which is mounted a hydraulic cylinder 13, the piston rod of which is coupled with the rope or cable of a Bowden cable 14. The ropes of the Bowden cable fork at 15 with one guide strand 16 leading to hinge or pivot lever 18 and the other guide strand 17 leading to hinge pivot lever 19. Levers 18 and 19 are each pivotably coupled at one end thereof to the center clamping bar 2 and the free ends thereof are pivotably coupled with the adjacent clamping bars 1 and 3 respectively. Further pivot levers are indicated at 18*a* and 19*a*. A pneumatic cylinder 20 is supported on center clamping bar 2 and its piston rod is coupled to the free end of lever 18.

The device operates as follows: When the piston rod of the hydraulic cylinder 13 extends or projects outwardly, the pivot levers 18 and 19 are pivoted by the Bowden cable 14 around their pivot points on the center clamping bar 2, whereby clamping bars 1, 3 are displaced laterally within their cross bushings 10 which are guided on lateral arms 6 and 7. Thus, a composite circular movement is generated whereby clamping bars 1, 2 and 3 move apart from each other, while the cross bushings slide on the lateral arms. Simultaneously, the clamping bars slide in the cross bushings 10 so that they are displaced with respect to each other in their longitudinal direction until a position is reached wherein the paving bricks 4 are again placed next to each other, offset however by half of a brick's length.

While only a single embodiment of the present invention has been shown and described, it will be obvious that many modifications and changes may be made thereunto, without departing from the spirit and scope of the invention.

What is claimed is:

1. In a gripper unit for clamping and aligning a layer of concrete paving bricks with combined compound elements for forming a stretcher bond of the bricks in the form of a setting unit of the type including a plurality of generally parallel clamping bars, each having clamping means at the longitudinal ends thereof for clamping a row of bricks therebetween, and a frame-like support element on which said clamping bars are slidably coupled by means of a guide cross bushing for simultaneous longitudinal and lateral displacement with respect to one another, the improvement comprising:

said clamping bars disposed adjacent to one another being pivotably coupled together by at least one common pivotable lever for permitting movement of said adjacent clamping bars while maintaining them in a parallel relationship with respect to one another during such movement; and actuating means coupled to said common lever for effecting pivotable movement of said common lever in at least a first direction, said actuating means comprising at least one actuable Bowden cable and an operating cylinder which is coupled to and activates said cable.

2. The gripper unit according to claim 1, additionally including means for moving said pivotable lever in a direction opposite to that of said first direction.

3. The gripper unit according to claim 2, wherein said means for moving comprises a pneumatic cylinder which acts against the pivot force of said operating cylinder when pivoting said lever.

* * * * *